United States Patent [19]

Bloom et al.

[11] Patent Number: 4,470,822

[45] Date of Patent: Sep. 11, 1984

[54] METHOD OF FABRICATING A METALIZED ELECTRODE ASSEMBLY

[75] Inventors: Stanley Bloom, Bridgewater; Eric F. Hockings, Princeton, both of N.J.

[73] Assignee: RCA Corporation, New York, N.Y.

[21] Appl. No.: 469,735

[22] Filed: Feb. 25, 1983

[51] Int. Cl.[3] ..... H01J 9/44

[52] U.S. Cl. ..... 445/5; 445/37; 445/58; 427/124

[58] Field of Search ..... 445/37, 47, 58, 5, 6; 427/124, 248, 250, 126.1, 126.2, 126.4, 64, 68, 69; 245/8; 313/403

[56] References Cited

U.S. PATENT DOCUMENTS

| | | | |
|---|---|---|---|
| 1,555,296 | 9/1925 | Kirschner | 245/8 |
| 2,677,070 | 4/1954 | Milligan | 427/126.1 |
| 2,745,772 | 5/1956 | Cassman | 427/126.2 |
| 2,815,462 | 12/1957 | Auphan | 427/126.2 |
| 2,967,962 | 1/1961 | Turk | 427/126.1 |
| 3,024,385 | 3/1962 | Burdick | 315/12 |
| 3,177,113 | 4/1965 | Golden et al. | 245/8 |
| 4,059,781 | 11/1977 | van Alphen et al. | 313/403 |
| 4,125,306 | 11/1978 | Coble | 445/5 |
| 4,188,562 | 2/1980 | Van Oostrum | 445/47 |
| 4,197,482 | 4/1980 | Koorneef et al. | 313/403 |
| 4,207,490 | 6/1980 | Van der Ven | 313/403 |
| 4,316,126 | 2/1982 | Hockings et al. | 315/375 |
| 4,427,918 | 1/1984 | Lipp | 313/403 |

FOREIGN PATENT DOCUMENTS 2814391 10/1978 Fed. Rep. of Germany .

*Primary Examiner*—Kenneth J. Ramsey
*Assistant Examiner*—Kurt Rowan
*Attorney, Agent, or Firm*—Eugene M. Whitacre; Dennis H. Irlbeck; Vincent J. Coughlin, Jr.

[57] ABSTRACT

The novel method of fabricating a color-selection electrode for a cathode-ray tube comprises a combination of step including providing substantially orthogonal sets of support members which cross at a multiplicity of locations to form an apertured array. At least one of the sets of support members are insulators. The method includes coating the array with a continuously conductive metal film except at the multiplicity of crossings and providing electrical terminals for each of the sets of coated members. A structure utilizing the novel method is also described.

15 Claims, 7 Drawing Figures

METHOD OF FABRICATING A METALIZED ELECTRODE ASSEMBLY

BACKGROUND OF THE INVENTION

This invention relates to an improved method of making an electrode assembly, such as a color-selection structure for a CRT (cathode-ray tube) and to a color-selection structure made according to the method.

A conventional shadow-mask-type color television picture tube, which is a CRT, includes generally an evacuated envelope having therein a target comprising an array of phosphor elements of three different emission colors arranged in color groups in cyclic order, means for producing three convergent electron beams directed toward the target, and a color selection structure having an apertured masking plate closely spaced from the target. The masking plate shadows the target, and the differences in convergence angles permit the transmitted portions of each beam to select and excite phosphor elements of the desired emission color.

At about the center of the color-selection structure, the masking plate of a commercial CRT intercepts all but about 18% of the beam currents; that is, the plate is said to have a transmission of about 18%. Thus, the area of the apertures of the plate is about 18% of the area of the masking plate. Since there are no focusing fields present, a corresponding portion of the target is excited by the beamlets of each electron beam.

Several methods have been suggested for increasing the transmission of the masking plate; that is, increasing the area of the apertures relative to the area of the plate, without substantially increasing the excited portions of the target area. In one approach, each of the apertures of the color-selection structure is defined by a quadrupolar electrostatic lens which focuses the beamlets passing through the lens in one transverse direction and defocuses them in the orthogonal transverse direction on the target depending upon the relative magnitudes and polarities of the electrostatic fields comprising the lens.

In one type of quadrupolar-lens color-selection structure described in U.S. Pat. No. 4,059,781 to W. M. van Alphen et al,., a strong focusing quadrupolar lens is generated from voltages applied between two sets of substantially-parallel conducting strips, each set being orthogonally positioned with respect to the other, and insulatingly bonded at the intersections of the strips.

In other type of quadrupolar-lens color-selection structure described in the same patent, interwoven or overlaid horizontal and vertical conductors are used. The conductors comprise conductive wires or strips which are covered with glass insulation. The conductors are interwoven or pressed against each other in the desired manner in a mold and heated so that the conductors with the glass insulation fuse together without making electrical contact with each other. The glass insulation must be removed from the conductors, with the exception of the crossings, to avoid undesired charging of the glass when the structure intercepts the electron beams. This structure has the disadvantages that complete removal of the glass insulation is difficult, and when incomplete, adversely affects the operation of the color-selection structure. Furthermore, removal of the glass insulation at the crossings must be avoided, since this renders the structure inoperative and is irreversible, since insulation cannot be reapplied.

In a second approach to increasing the transmission of the masking plate, each aperture in the masking plate is enlarged and split into two adjacent windows by a conductor. The two beamlets passing through the windows of each aperture are deflected around the conductor towards one another, and both beamlets fall on substantially the same are of the target. In this second approach, the transmitted portions of the beams are also focused in one transverse direction and defocused in the orthogonal transverse direction.

One effort at such a combined deflection-and-focus color-selection means is described in West German Offenlegungschrift No. 2,814,391, published Oct. 19, 1978. That publication discloses a CRT having a target, as normally viewed, comprised of a mosaic of vertical phosphor stripes of thre different emission colors arranged cyclically in triads (groups of three different stripes), means for producing three convergent horizontally in-line electron beams directed towards the target, and a color-selection structure located adjacent the target. The color-selection structure compirses a metal-masking plate having therein an array of substantially square apertures arranged in vertical columns, and an array of narrow vertical conductors insulatingly spaced from the masking plate, with each conductor substantially centered over the apertures of each of the columns of apertures. Each apertures is also centered over a triad of phosphor stripes. Viewed from the electron-beam-producing means, the conductors divide each aperture into two essentially-equal horizontally-coadjacent windows. This prior color-selection structure has windows with a width-to-height ratio of about 0.46 and transmits about 44% or less of the electron beams.

This latter device constructed by the insulated-conductor method described in the aforementioned van Alphen et al. patent would have the same disadvantages enumerated with respect to those structures.

In any of these and similar structures, it is a major problem to construct an array of conductors that are electrically insulated from one another with the insulation not exposed to the electron beams as is required for use in a CRT color-selection structure. A need therefore exists for a focusing structure which can be fabricated inexpensively, reproducibly and reliably.

SUMMARY OF THE INVENTION

The novel method comprises a combination of steps including providing substantially orthogonal sets of support members which cross at a multiplicity of locations to form an apertured array, at least one of said sets comprising insulative support members. The method includes coating said array with a metal film except at said multiplicity of locations where the crossings occur.

DETAILED DESCRIPTION OF THE PREFERRED EMBODIMENT

Figure 1:
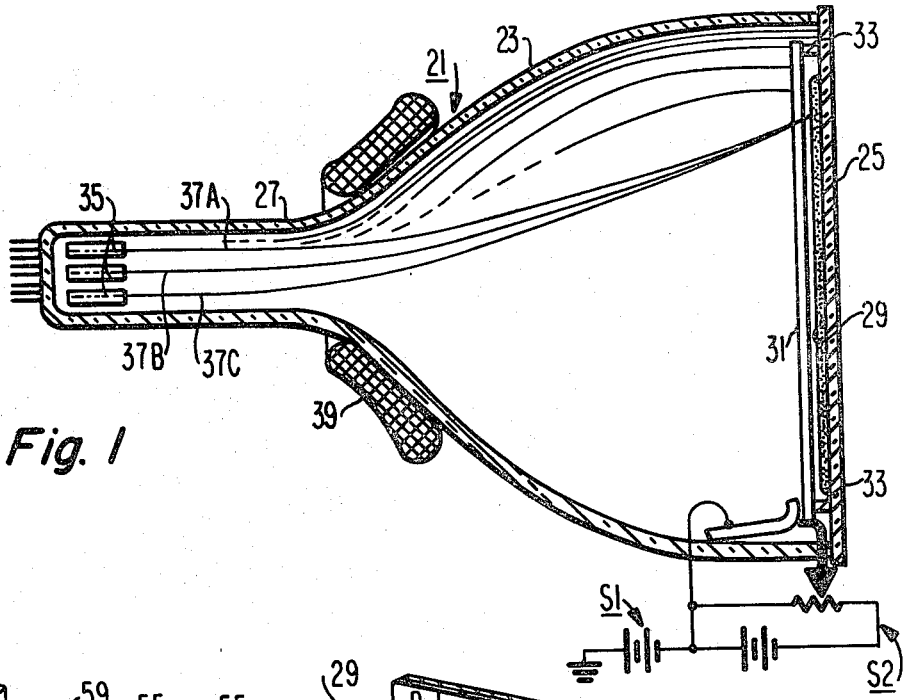
FIG. 1 is a partially-schematic sectional-view of an embodiment of a CRT incorporating a color-selection structure made by the novel method of the present invention.

The color television picture tube 21 shown in FIG. 1 comprises an evacuated bulb 23 including a transparent faceplate 25 at one end and a neck 27 at the other end. The faceplate 25, which is shown as being flat, but may arc outwardly, supports a luminescent viewing screen or target 29 on its inner surface. Also, a color-selection structure 31 is supported from three supports 33 on the inside surface of the faceplate 25. Means 35 for generating three electron beams 37A, 37B and 37C are housed in the neck 27. The beams are generated in substantially a plane, which is preferably horizontal in the normal viewing position. The beams are directed towards the screen 29 with the outer beams 37A and 37C convergent on the center beam 37B at the target 29. The three beams may be deflected with the air of deflection coils 39 to scan a raster over the color-selection structure 31 and the viewing screen 29.

Figure 2:
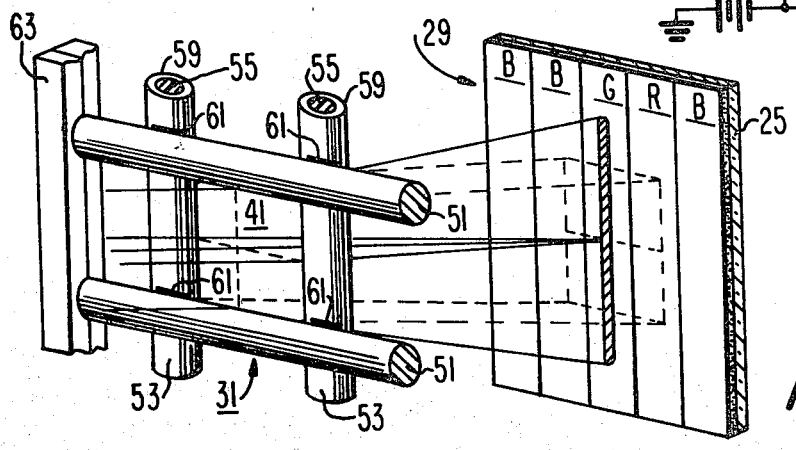
FIG. 2 is a perspective view of a fragment of an overlaid quadrupole color-selection structure made according to the method of the present invention.

The viewing screen 29 and the color-selection structure 31 are described in more detail with respect to FIG. 2. The viewing screen 29 comprises a large number of red-emitting, green-emitting and blue-emitting phosphor stripes R, G and B, respectively, arranged in color groups of three stripes or triads in a cyclic order and extending in a direction which is generally normal to the plane in which the electron beams are generated. In the normal viewing position for this embodiment, the phosphor stripes extend in the vertical direction. The phosphor stripes also could be separated from each other by light-absorbing material as is known in the art.

The color-selection structure 31 comprises substantially orthogonal sets of support members which intersect or cross at a multiplicity of locations to form an array of apertures 41. The method of the present invention can be utilized in the fabrication of a number of different types of color-selection structures.

Figure 4:
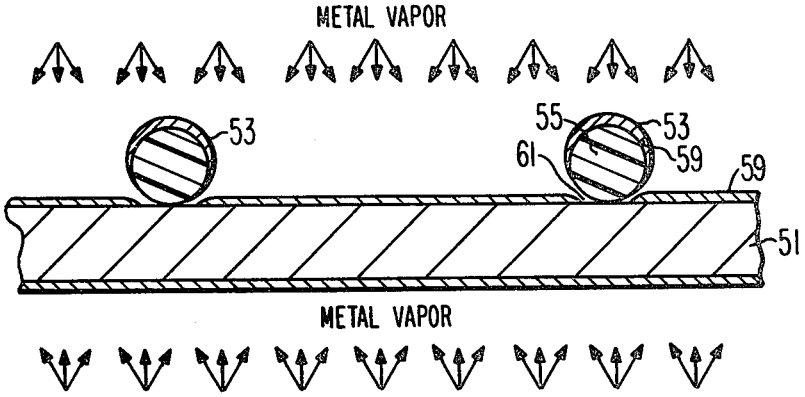
FIG. 4 is an enlarged fragmentary view of a portion of the color-selection structure of FIG. 2.

An overlaid quadrupole color-selection structure 31 produced by the present method, is shown in FIGS. 2 and 4. The electrical operation of the quadrupole color-selection structure generally is described in U.S. Pat, No. 4,059,781, referenced above. Briefly, if the screen 29 operates at a potential, $V_o$, the horizontal conductors of the quadrupole lens also operate at a potential of $V_o$ and the vertical conductors operate at a potential of $V_o-\Delta V$. Alternatively, the horizontal conductors may operate at a potential of $V_o+\Delta V$ and the vertical conductors may operate at a potential of $V_o$. The present structure, made by the novel method, includes a horizontally disposed set of support members 51, e.g., conductive wires, and a vertically extending set of support members 53. The support members 51 and 53 are of suitable cross section to provide shadowing as will be described hereinafter. The vertical extending support members 53 have a core of insulative material 55, as shown in FIGS. 2 and 4. In the overlaid structure of FIGS. 2 and 4, the insulative core 55 of the vertical support members 53 is bonded to the horizontal support members 51 to form a rigid structure. The vertical support members 53 have a coating of a metal film 59 disposed thereon except at the multiplicity of locations where a crossing 61 is formed at the intersection where the vertical support member 53 and a horizontal support member 51 are bonded. Since the crossings 61 do not have a coating of the metal film 59, the horizontal members 51 and the metal film 59 on the vertical support members 53 are electrically insulated from one another and are continuously conductive. Electrical terminals, such as terminal 63, are attached to each of the sets of horizontal and vertical support members 51 and 53 to facilitate applying electrical potentials thereto.

To fabricate the color-selection structure 31, the orthogonal sets of support members 51 and 53 are placed in a suitable vacuum enclosure, such as a bell jar (not shown). The bell jar is evacuated, and a thin conductive film 59, of aluminum metal or any other suitable metal, is deposited on the support members 51 and 53. Preferably, the deposition occurs onto opposite sides of the structure 31, as shown in FIG. 4 to provide a continuous conductive metal film 59. Since the aluminum evaporates in a straight line, the crossings 61 are shadowed by the overlying support members 51 and 53, and the junctions 61 are free of the metal film 59. To provide the required shadowing, the members 51 and 53 preferably should have a circular, oval, or triangular cross-section with the triangles oriented so that the flat sides are not adjacent to one another in order to avoid bridging of the metal film 59 on the support members 51 and 53 at athe crossings 61. In the event that the metal film 59 bridges some of the crossings 61 and interconnects desired conductive portions of the support members 51 and 53, the interconnections can be removed by "spot-knocking", i.e., by passing a high current between the horizontal and vertical sets of support members. The metal film deposition is terminated when the film thickness is sufficient to provide adequate conductivity. While evaporation is described as being the preferred procedure for depositing the metal film 59 onto the support members 51 and 53, any equivalent method of applying a thin conductive coating may be used. The color-selection structure described heretofore utilized conductive members for at least one set of the orthogonal sets of support members; however, the present novel method also permits the use of insulative members for both sets of support members. Furthermore, the color-selection structure may comprise interwoven rather than overlaid support members.

Figure 3:
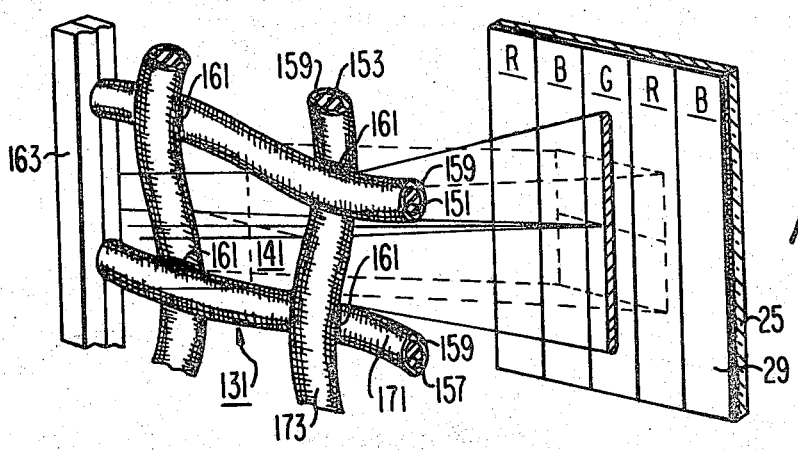
FIG. 3 is a perspective view of a fragment of a woven quadrupole color-selection structure made according to the method of the present invention.
Figure 5:
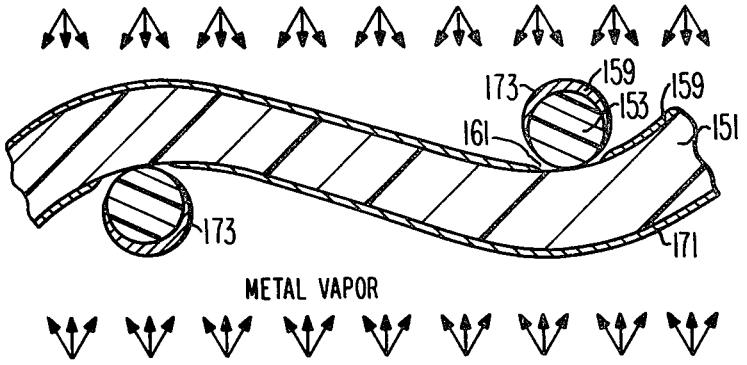
FIG. 5 is an enlarged fragmentary view of a portion of the color-selection structure of FIG. 3.

FIG. 3 shows a quadrupole color-selection focuse mask structure 131 made from sets of woven insulating fibers, and metalized by the present method. The structure 131 is similar to structure 31 shown in FIG. 2. The sets of insulating fibers are designated as 151 (horizontal set) and 153 (vertical set), respectively. The fiber sets had a circular cross-section with a diameter of 0.23 mm (9.2 mils) and were woven to provide square apertures 141 with a period averaging 0.80 mm (31.5 mils). Since the structure 131 was woven, it was not necessary to bond the sets of fibers 151 and 153 together. The woven structure 131 was aluminized from each side as shown in FIG. 5 to provide a continuously conductive metal film 159 having a thickness of about 2500Å on the horizontal and vertical members 141 and 153 to form conductive members 171 and 173, respectively. To ensure proper coverage by the film 159, the structure 131 was oscillated slightly during the vapor deposition. The structure 131 was aluminized sequentially from each side; however, simultaneous deposition of aluminum could have been used. Electrical terminals 163 were then attached to the separate horizontal and vertical conductive members 171 and 173. The structure 131 was tested with a focus mask-to-screen spacing of 13.7 mm (540 mils), and it was found that color purity could be achieved with a bias voltage of less than 200 volts and typically about 16514 175 volts, at an ultor voltage of 10kV. Thus, in a tube operating at an ultor voltage of 25kV, a bias voltage of not more than 500 volts would be required on the color-selection structure 131.

Figure 6:
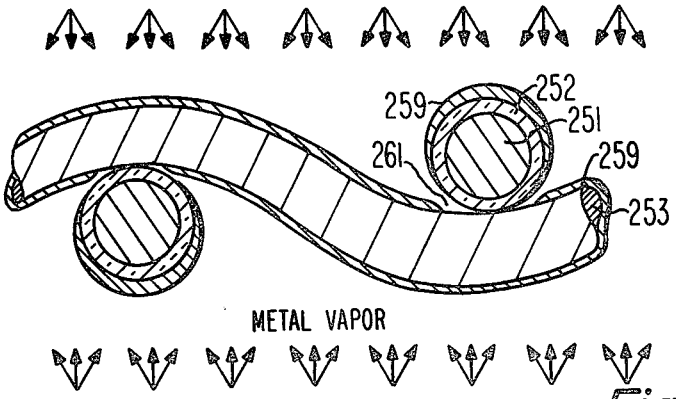
FIG. 6 is an enlarged fragmentary view of a portion of a color-selection structure made according to the method of the present invention showing support members having a conductive core surrounded by an insulative layer coated with a metal film.

As described herein, the core of the support members 51, 53 and 151, 153 of the color-selection structure 31 and 131 can be of various types of materials. The woven sets of core members may be entirely insulating, e.g., made of glass or polymer fibers, or the structure 31, 131 may comprise both conductive strands and insulative strands, or conductive strands with at least one set of conductors coated with a thin layer of insulative material, the latter structure is shown in FIG. 6. With reference to FIG. 6, a set of conductors 251 is provided with an insulative layer 252 of a suitable material, e.g., glass, to electrically insulate the conductors 251 from an orthogonal set of conductors 253. A continuously conductive metal film 259, such as the aluminum film described herein, is deposited on the insulative layer 252 of conductors 251 and on conductors 253. The metal film 259 is not deposited at the crossings 261 because of the shadowing effect created by the circular cross-section of the conductors 251 and 253, respectively.

Figure 7:
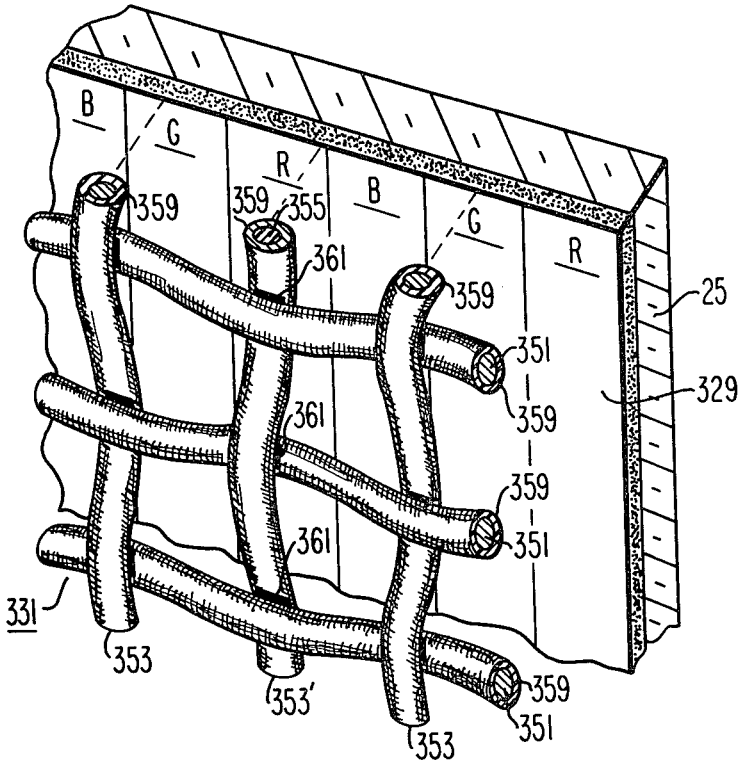
FIG. 7 is a perspective view of a fragment of a dipole-quadrupole color-selection structure made according to the method of the present invention.

The metalizing method described herein may also be utilized to make a dipole-quadrupole color-selection structure 331, such as that shown in FIG. 7. Dipole-quadrople focusing structures are known in the art and are described, e.g., in West German Offenlegungschrift No. 2,814,391, pulbished Oct. 19, 1978 and referenced above, and in U.S. Pat. No. 4,316,126, issued to E. F. Hockings et al. on Feb. 16, 1982. The color-selection structure 331 comprises a horizontally disposed set of conductors 351 and two vertically extending sets of conductors 353 and 353'. The set 353' of conductors is interleaved with the set 353 and must comprise either a core of insulative material 355, as shown, or alternatively, a conductive core surrounded by an insulative layer similar to that described with respect to the structure shown in FIG. 6. The insulative material (either core 355 or the insulative layer surrounding the conductive core) is vapor-coated with a thin metal film 359 in the manner described above. The vapor coating provides a substantially uniform, continuously conductive metal film 359 over the sets which comprise the array 331; however, the crossings 361 formed by the intersection of the overlying sets of conductors are devoid of metal film 359 because of the shadowing effect of the circular cross-section conductors 351, 353 and 353'.

In the operation of the dipole-quadrupole structure 331, the horizontal set of conductors 351 and the vertical set of conductors 353 operate at a potential of $V_o$ where $V_o$ is the potential on the screen 329. The remaining set of vertical conductors 353', which are electrically insulated from the conductors 351 at the junctions 361, operate at a potential of $V_o - \Delta V$. Alternatively, the horizontal set of conductors 351 and the vertical set of conductors 353 may be operated at a potential of $V_o + \Delta V$, and the vertical conductors 353' may be operated at a potential of $V_o$. Electrical terminals (not shown) but similar to terminals 63 are provided for each of the electrically separate sets of conductors of the color-selection structure 331.

While the above method was described with respect to a CRT focus mask structure, the method may also be used to form x-y addressable assemblies, e.g., electrodes in a gas plasma device, in which case the electrodes will be provided with individual terminals to permit individual addressing.

What is claimed is:

1. A method of fabricating an electrode assembly comprising

A. providing a plurality of substantially orthogonal sets of support members which cross at a multiplicity of locations to form an apertured array, at least one of said sets comprising insulative support members, and B. coating the members of said array with a metal film except at opposing surfaces of said muliplicity of locations where said members cross.

2. The method of claim 1 wherein said coating step comprises depositing said metal film onto opposite sides of said array.

3. The method of claim 1 including the step of providing electrical terminals for each of said coated members.

4. The method of claim 1 further including the step of spot-knocking said coated array by passing a high current between said electrical terminals to remove any of said metal film from said multiplicity of locations.

5. A method of fabricating a color-selection electrode for a cathode-ray tube comprising A. providing an overlaid structure having a plurality of substantially orthogonal sets of support members which cross at a multiplicity of locations, at least one of said sets comprising insulative support members, and B. coating said support members with a metal film except at opposing surfaces of said multiplicity of locations where said members cross thereby forming orthogonal sets of conductors insulated from one another.

6. The method of claim 5 wherein said coating step comprises depositing said metal film onto opposite sides of said structure.

7. The method of claim 5 including the step of providing electrical terminals for each of said sets of conductors.

8. The method of claim 5 further including the step of spot-knocking said coated structure by passing a high current between said electrical terminals to remove any of said metal film from said multiplicity of locations.

9. A method of fabricating a color-selection electrode for a cathode-ray the comprising A. providing a woven mesh having a plurality of substantially orthogonal sets of mesh members which cross at a multiplicity of locations, at least one of said sets comprising insulative mesh members, B. coating said woven mesh with a metal film except at said multiplicity of locations where said crossings occur, thereby forming orthogonal sets of conductors insulated from one another, and C. providing electrical terminals for each of said sets of conductors.

10. The method of claim 9, wherein said coating step includes the steps of i. placing said woven mesh in a vacuum enclosure, ii. evacuating said enclosure, and iii. depositing said metal film onto opposite sides of said woven mesh.

11. The method of claim 9 further including the step of spot-knocking said coated woven mesh by applying a high current between said electrical terminals to remove any of said metal film from said multiplicity of locations.

12. An electrode assembly comprising a plurality of substantially orthogonal sets of support members which cross at a multiplicity of locations to form an apertured array, at least one of said sets comprising insulative support members, and a metal film deposited on said support members of said array except at opposing surfaces of said multiplicity of locations where said support members cross.

13. A color-selection electrode for a cathode-ray tube comprising a plurality of substantially orthogonal sets of support members which cross at a multiplicity of locations, at least one of said sets comprising insulative support members, and a metal film deposited on said support members except at opposing surfaces of said multiplicity of locations where said members cross, thereby forming orthogonal sets of conductors insulated from one another.

14. The color-selection electrode as described in claim 13 including an electrical terminal for each of said sets of conductors.

15. A color-selection electrode for a cathode-ray tube comprising a first set of spaced-apart support conductors, a second set of spaced-apart support conductors disposed substantially orthogonal to said first set of support conductors, a third set of spaced-apart insulative members, said insulative members of said third set being disposed parallel to and interleaved with said spaced apart conductors of said second set so that said third set of members is also orothogonal to said first set of conductors, a metal film deposited on said conductors and said insulative members except at opposing surfaces of said multiplicity of locations where said third set of insulative members and said first set of conductors cross, thereby providing a conductive coating on said third set which is insulated from said first and second sets of conductors, means for applying a first potential to said first and second sets of conductors, and means for applying a second potential, different from said first potential, to said third set.

* * * * *

UNITED STATES PATENT AND TRADEMARK OFFICE

CERTIFICATE OF CORRECTION

PATENT NO. : 4,470,822

DATED : September 11, 1984

INVENTOR(S) : Stanley Bloom et al.

It is certified that error appears in the above-identified patent and that said Letters Patent is hereby corrected as shown below:

Col. 2, Line 7 - "same are" should be -- same area -- ;

Col. 2, Line 17 - "thre" should be -- three -- ;

Col. 2, Line 21 - "compirses" should be -- comprises -- ;

Col. 2, Line 27 - "apertures" 2nd occurrence should be --aperture--;

Col. 3, Line 28 - "air" should be -- aid -- ;

Col. 3, Line 52 - "U.S. Pat," should be -- U.S. Pat. -- ;

Col. 4, Line 32 - "athe" should be -- the -- ;

Col. 4, Line 51 - "focuse" should be -- focus -- ;

Col. 4, Line 65 - "141" should be -- 151 -- ;

Col. 5, Line 9 - "16514 175 volts" should be -- 165-175 volts -- ; and

Col. 5, Line 37 - "pulbished" should be -- published -- .

Signed and Sealed this

*Thirtieth* Day of *July 1985*

[SEAL]

*Attest:*

DONALD J. QUIGG

*Attesting Officer* *Acting Commissioner of Patents and Trademarks*